United States Patent [19]

Willis

[11] 4,324,332

[45] Apr. 13, 1982

[54] MIRROR PACKAGE

[75] Inventor: Larry G. Willis, Vincennes, Ind.

[73] Assignee: Hamilton Glass Products Incorporated, Vincennes, Ind.

[21] Appl. No.: 199,844

[22] Filed: Oct. 23, 1980

[51] Int. Cl.[3] ..... B65D 85/48

[52] U.S. Cl. ..... 206/454; 206/445; 206/460

[58] Field of Search ..... 206/450, 451, 453, 454, 206/44 B, 445, 449, 460

[56] References Cited

U.S. PATENT DOCUMENTS

| | | | |
|---|---|---|---|
| 1,256,818 | 2/1918 | Nice | 206/454 |
| 3,432,028 | 3/1969 | Nathan et al. | 206/454 |
| 3,586,234 | 6/1971 | Nathan | 206/454 |
| 3,596,756 | 8/1971 | Nathan | 206/454 |
| 3,939,978 | 2/1976 | Thomaswick | 206/454 |
| 4,047,612 | 9/1977 | Lohmann | 206/454 |

FOREIGN PATENT DOCUMENTS

| | | | |
|---|---|---|---|
| 1566682 | 3/1969 | France | 206/454 |

*Primary Examiner*—Joseph Man-Fu Moy
*Attorney, Agent, or Firm*—Robert E. Browne

[57] ABSTRACT

A mirror package for the display, handling and transporting of mirrors or like flat, rigid, yet relatively fragile, articles, being formed from a single blank of sheet material to which the mirror is rigidly and permanently affixed. The sheet material includes a central panel, larger in all directions than the mirror which is affixed thereto in spaced relation from all edges of the central panel, and forwardly folded flanges held rigidly in the forwardly folded relationship. The central panel is adapted to be severed by a consumer leaving the portion behind the mirror to function as a permanent backing for the mirror.

10 Claims, 3 Drawing Figures

MIRROR PACKAGE

This invention relates to a mirror package, and, more particularly, to a mirror package having a portion of the packaging sheet material adapted to remain permanently as a backing for the mirror.

Heretofore, in view of the fragile character of mirrors, they are shipped, displayed and sold in a package, all of which is discarded by the consumer. It has also been common practice to provide a backing on mirrors, which backing has characteristics somewhat similar to the materials commonly used for forming packaging.

Prior patents disclosing corrugated paper packages for mirrors and the like include U.S. Pat. Nos. 3,432,028; 3,586,234; 3,596,756 and 3,602,367, all providing a display package for mirrors which permit varying degrees of exposure of the product to a consumer's view, varying degrees of protection for the product during shipping and display, and means for placing necessary marketing information on the product as is essential in store displays. All contemplate the discarding of the total package prior to use of the mirror.

It is an object of the present invention to provide a protective display package for a flat article such as a mirror, picture, decorative panel or the like, wherein the mirror or the like is permanently affixed to the packaging material with the portion of packaging material so permanently affixed being readily separable by the consumer from the rest of the package to function as a permanent backing for the mirror or the like.

It is a further object to provide a mirror package which provides both protection for the front face of the mirror while leaving the mirror completely exposed for inspection by prospective consumers.

It is a still further object to provide a mirror package which can incorporate various means for securement of the mirror to the packaging material.

These and other objects and advantages of the present invention will be more fully apparent when considered in relation to the preferred embodiments thereof as set forth in the specification and as shown in the drawings in which.

Figure 1:
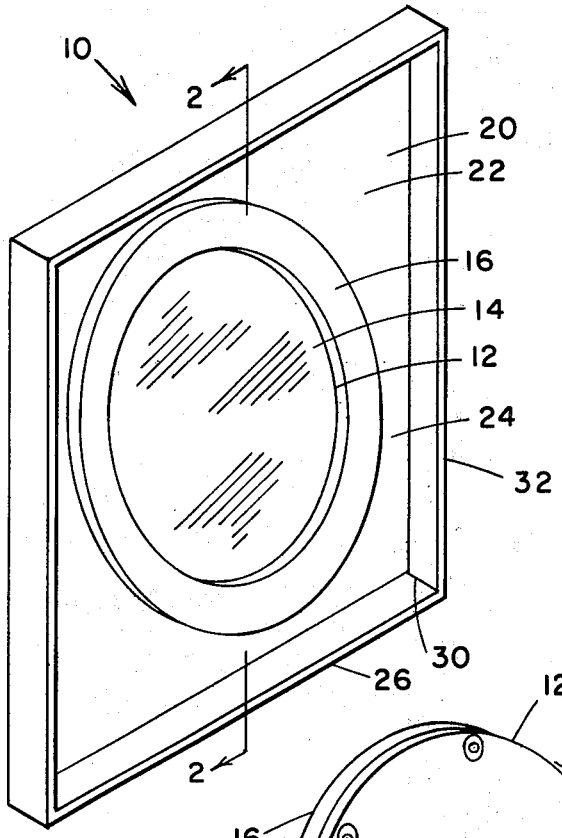
FIG. 1 is an isometric front view of the mirror package of the present invention.
Figure 2:
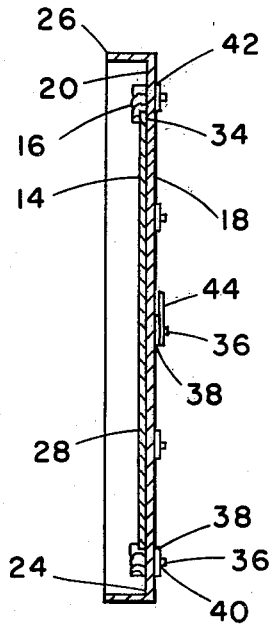
FIG. 2 is a sectional view of the mirror package of FIG. 1 taken along line 2—2.
Figure 3:
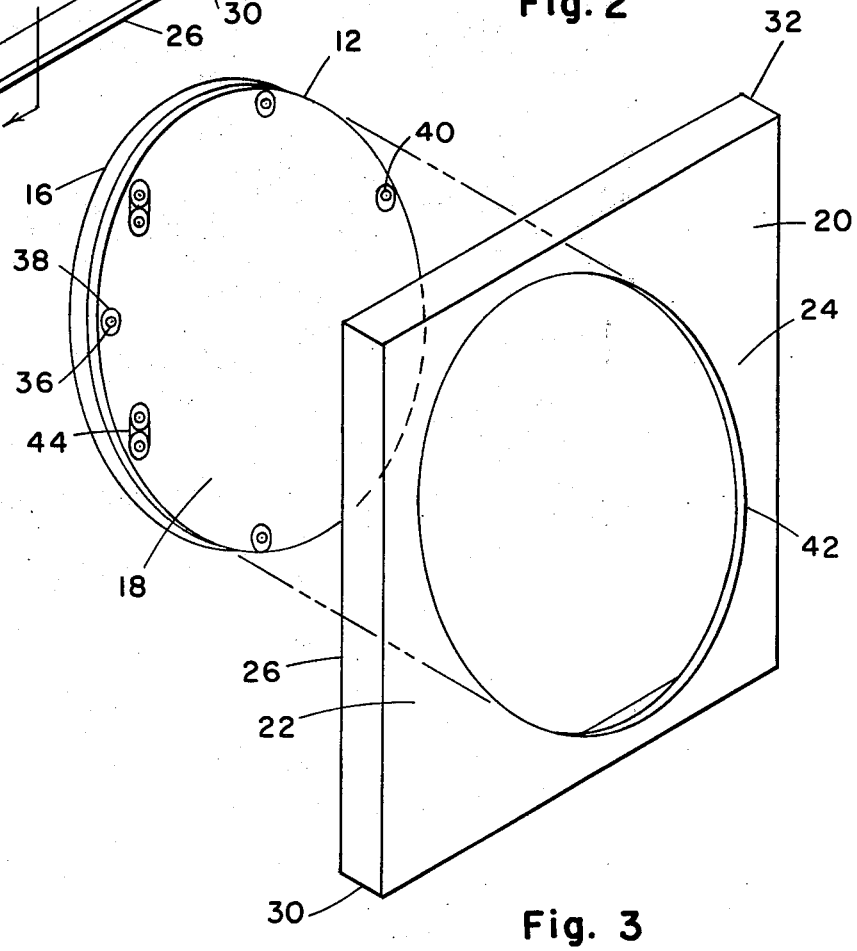
FIG. 3 is an isometric rear view of mirror being removed from the mirror package.

Referring to the drawings, there is shown a mirror package 10 consisting of a three-component mirror 12, the three components of which are the flat rigid, relatively fragile silver-backed sheet of glass 14, the frame 16 disposed around the edge of glass 14 and the mirror corrugated paper back 18.

The mirror corrugated paper back 18 is an integral portion of a formed single blank 20 of corrugated paper, of approximately one-eighth inch to one-fourth inch in thickness. In the embodiment shown, formed blank 20 includes a central panel 22, which in the embodiment shown is a square panel, the preferable shape for use with a circular mirror. Central panel 22 includes, in addition to mirror corrugated paper back 18, a border portion 24, providing protection from damage to the edges of mirror 12. Formed blank 20 further includes a forwardly folded flange 26 extending from each edge of central panel 22, having a width sufficient to extend forwardly beyond the front-most portion 28 of mirror 12.

The four flanges 26 are suitably adjoined to one another at each corner 30 of central panel 22, whereby formed blank 20 forms an open-topped, shallow box 32 with the glass 14 and frame 16 elements of the mirror 12 being disposed within the shallow box 32.

In accordance with the invention, the glass 14 is firmly affixed to the corrugated paper back 18 at least throughout the area along the edge 34 of the mirror back face. In the embodiment shown the mirror edge is affixed to the corrugated paper back by plastic male studs 36 which extend from frame 16 through holes in the corrugated paper back 18 and flat push washers 38 having an inner periphery 40 which grasps studs 36 and become permanently held thereon.

In the embodiment shown there are eight studs 36 and washers 38 spaced equidistantly apart around the periphery of mirror 12. By this firm attachment of the frame 16 and of the glass 14 along its outer edge, severance of the mirror corrugated paper back 18 from the balance of formed blank 20 is made relatively easy.

In the preferred embodiment, severance of the back 18 is aided also by the provision of a compressed, partially perforated weakened line in the central panel 22 at the edge of frame 16 or slightly inwardly therefrom.

It will be understood that the mirror can be of any shape, as well as circular, such as oval, square, rectangular etc. The shape of central panel 22 may then be varied accordingly to best accommodate the mirror shape with a suitable border 24 and a plurality of straight edges, folded outwardly from which are an equal plurality of flanges, adjoined at ends to form box 32 of any reasonable number of sides.

The mirror could, in accordance with the invention, have a corrugated paper back which is adhered to the other elements of the mirror, around the periphery at least, by other means such as an adhesive. The other elements could consist of solely a silver-backed glass 14, adhered to the central panel 22 at the corrugated paper back 18 portion thereof.

The sheet material used for the formed blank could be some other semirigid sheet material, such as heavy kraft board, so long as it can be made to be readily severed along the periphery of the mirror back face, as by a knife, scissors or razor, or by tearing along a well perforated line as at 42.

The mirror back side may also be equipped with two or three hangers 44, shown in the present embodiment disposed between washers 38 and mirror corrugated paper back 18.

Having completed a detailed disclosure of the preferred embodiments of my invention, so that others may practice the same, I contemplate the variations may be made without departing from the essence of the invention or the scope of the appended claims.

I claim:

1. A package comprising a mirror glass or like flat article and a formed blank of semirigid sheet material, said formed blank comprising a central panel rigidly affixed to the back face of said mirror glass, said central panel having a border extending beyond the edge of said mirror glass in all directions, said formed blank further comprising flange portions folded out of the plane of said central panel and extending in a direction from said plane toward the side of said plane on which said mirror glass is affixed, providing a spacing means to protect the front face of said mirror glass, said central panel being adapted to be readily severed to remove said border and said flanges by means which would assist in such severance including a firm and rigid affixation of said central panel at least throughout the area along the edge of said mirror glass back face.

2. A mirror package as defined in claim 1 wherein said mirror glass removal assistance means includes a line of perforations formed in said central panel along a path defined by the edge of said mirror glass.

3. A packaged mirror comprising a mirror and a formed single blank of semirigid sheet material, wherein said mirror comprises a thin, flat rigid, relatively fragile element and a semirigid flat back sheet rigidly affixed to the back side of said fragile element at least around the outer periphery, the improvement wherein said semirigid flat back sheet is a portion of said formed single blank of semirigid sheet material, said formed single blank of sheet material comprising a central panel having said back sheet as a portion thereof with a border portion extending outwardly therefrom in all directions, said formed single blank further comprising a plurality of folded edge flanges extending out of the plane of said central panel in the direction of the side of the central panel to which said fragile element is affixed, whereby a spacer is formed to protect the face of said fragile element.

4. The packaged mirror of claim 3, wherein said mirror comprises a silver-backed glass firmly affixed to said flat back sheet.

5. The packaged mirror of claim 3, wherein said formed single blank is a sheet of corrugated paper.

6. The packaged mirror of claim 3 wherein said flanges extend the complete length of each side of said central panel and are adjoining one to another at each corner of said central panel, forming a shallow box.

7. The packaged mirror of claim 3 wherein said fragile element is affixed to said back sheet by a frame disposed around the edge of said fragile element which is rigidly affixed to said back sheet with the edge of said fragile element held therebetween.

8. The packaged mirror of claim 7 wherein said frame has a plurality of studs extending through said sheet with locking washers holding said back sheet.

9. The packaged mirror of claim 3 wherein at least one mirror hanger is affixed to said mirror on the back thereof.

10. The packaged mirror of claim 3 wherein a line of performations is formed in said central panel along a path defined by the edge of said mirror.

* * * * *